United States Patent [19]

Newman et al.

[11] Patent Number: 4,758,329

[45] Date of Patent: Jul. 19, 1988

[54] PREMIUM COKING PROCESS

[75] Inventors: Bruce A. Newman; Ta-Wei Fu, both of Ponca City, Okla.

[73] Assignee: Conoco Inc., Ponca City, Okla.

[21] Appl. No.: 20,404

[22] Filed: Mar. 2, 1987

[51] Int. Cl.[4] ..... C10G 9/14

[52] U.S. Cl. ..... 208/131; 208/106

[58] Field of Search ..... 208/131

[56] References Cited

U.S. PATENT DOCUMENTS

| | | | |
|---|---|---|---|
| 1,916,026 | 6/1933 | Smith et al. | 208/131 |
| 3,338,817 | 8/1967 | Zrinscak et al. | 208/131 |
| 3,956,101 | 5/1976 | Hara et al. | 208/50 |
| 4,036,736 | 7/1977 | Ozaki et al. | 208/106 |
| 4,518,486 | 5/1985 | Jansma | 208/131 |
| 4,519,898 | 5/1985 | Allan | 208/131 |

FOREIGN PATENT DOCUMENTS

| | | |
|---|---|---|
| 2140028 | 5/1984 | United Kingdom . |

*Primary Examiner*—Patrick P. Garvin
*Assistant Examiner*—George R. Fourson
*Attorney, Agent, or Firm*—C. R. Schupbach

[57] ABSTRACT

In a delayed premium coking process utilizing as feedstock an aromatic mineral oil having a high aromatic content and a low molecular weight, coke CTE is reduced and coke particle size is increased by sparging with a gas during the coking cycle.

10 Claims, 1 Drawing Sheet

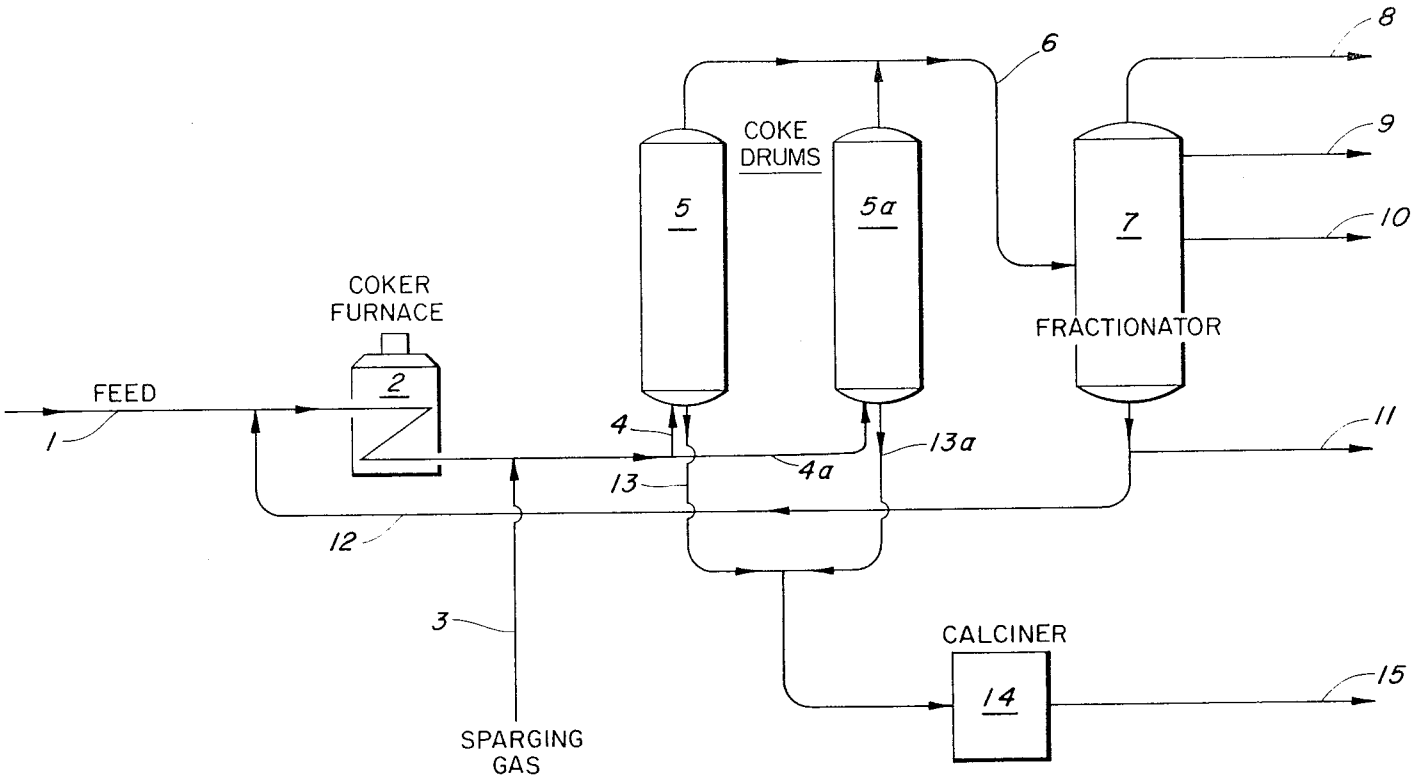
8
9
10
11
15
7
FRACTIONATOR
6
CALCINER
14
13a
5a
4a
COKE DRUMS
5
4
13
SPARGING GAS
3
COKER FURNACE
2
12
FEED
1

PREMIUM COKING PROCESS

BACKGROUND AND SUMMARY OF THE INVENTION

There is an increasing demand for high quality premium coke for the manufacture of large graphite electrodes for use in electric arc furnaces employed in the steel industry. A number of properties are of importance in characterizing the quality of graphite electrodes. One such property is density. Usually the higher the density the better the electrode. The quality of premium coke used in graphite electrodes is also measured by its coefficient of thermal expansion, which may vary from as low as zero to as high as plus eight centimeters per centimeter per degree centigrade $\times 10^{-7}$. Users of premium coke continuously seek graphite materials having higher densities and lower CTE values.

Premium coke is manufactured by delayed coking in which heavy hydrocarbon feedstocks are converted to coke and lighter hydrocarbon products. In the process the heavy hydrocarbon feedstock is heated rapidly to cracking temperature and is fed into a coke drum. The heated feed soaks in the drum in its contained heat which is sufficient to convert it into coke and cracked vapors. The cracked vapors are taken overhead and fractionated, with the fractionator bottoms being recycled to the feed if desired. The coke accumulates in the drum until the drum is filled with coke, at which time the heated feed is diverted to another coke drum while the coke is removed from the filled drum. After removal, the coke is calcined at elevated temperatures to remove volatile materials and to increase the carbon to hydrogen ratio of the coke.

In the manufacture of large graphite electrodes, calcined premium coke particles obtained from the delayed coking process are mixed with pitch, extruded to form green electrodes, and then baked at elevated temperatures to carbonize the pitch. Since pitch loses its density faster than coke the higher the percentage of coke in the mixture the greater the density of the resulting electrode. The percentage of coke can be maximized by providing the proper gradation of size of coke particles. Often in premium coking operations an excess of small particles is produced, and the resulting electrodes do not reach maximum density and strength. Providing the electrode manufacturer with coke of larger particle size gives the manufacture the flexibility to obtain desirable size distribution, e.g. by converting some large particles to particles of intermediate or smaller size. Thus it is desirable to provide a process which produces a higher proportion of larger coke particles.

Electrode performance is inversely proportional to coke CTE; reduced CTE increases electrode performance. This is reflected primarily in the lower consumption rate of electrodes with reductions in coke CTE. Thus, it is also desirable to provide a process which produces lower CTE coke.

According to this invention, premium coke having a lower CTE and increased particle size is obtained by carrying out the delayed premium coking of an aromatic mineral oil having a high aromatics content and a low molecular weight in the presence of a sparging non-coking gaseous material.

PRIOR ART

U.S. Pat. No. 4,518,486 discloses a process in which an aromatic concentrate, such as a 600° F. to 1000° F. fraction obtained from catalytic cracking, is delayed coked in the presence of non-coking feed supplement, such as light gas oil, to provide a premium coke having improved properties. The ratio of feed supplement to aromatic concentrate is preferably increased during the latter part of the coke cycle.

U.K. Patent Application No. 8412677 teaches the introduction of a gas into a coking drum (delayed coking process) during the coking process to strip volatile matter from the coke product. The gas, which may be steam, nitrogen, hydrocarbon gases or mixtures thereof, constitutes about 5 to about 40 weight percent of the coking feed.

U.S. Pat. No. 3,956,101 discloses production of high grade coke by bubbling light hydrocarbon vapors or other non-oxidizing gas through a coking drum during coking.

U.S. Pat. No. 4,036,736 describes a delayed coking process for producing synthetic coking coal. The process is carried out in the presence of an inert diluent gas such as nitrogen, steam, or light hydrocarbons.

BRIEF DESCRIPTION OF THE DRAWING

The drawing is a schematic flow diagram of a premium coking unit adapted for carrying out the invention.

DETAILED DESCRIPTION OF THE INVENTION

The fresh feedstocks used in carrying out the invention are heavy aromatic mineral oil fractions. These feedstocks can be obtained from several sources including petroleum, shale oil, tar sands, coal and the like. Specific feedstocks have a high aromatic content, usually at least about 65 percent carbon in the aromatic form (as determined by carbon$^{13}$ nuclear magnetic resonance analysis), and preferably at least 75 percent. Suitable feedstocks also have a low molecular weight, not greater than about 650, and preferably not greater than about 500, in the fraction of the feed boiling above 750° F. Such feedstocks include decant oil, also known as slurry oil or clarified oil, which is obtained from fractionating effluent from the catalytic cracking of gas oil and/or residual oils. Another feedstock which may be employed is ethylene or pyrolysis tar. This is a heavy aromatic mineral oil which is derived from the high temperature thermal cracking of mineral oils to produce olefins such as ethylene. Thermal tar may also be used as a feedstock. This is a heavy oil which may be obtained from fractionation of material produced by thermal cracking of gas oil or similar materials. Another feedstock which may be used is extracted coal tar pitch. Any of the preceding feedstocks may be used singly or in combination. In addition, any of the feedstocks may be subjected to hydrotreating and/or thermal cracking prior to their use for the production of premium grade coke.

The diluent material used in sparging the coking reaction may be any material which is non-coking and a gas under coking conditions of temperature and pressure. For example the diluent may be a liquid hydrocarbon (at ambient conditions) or a normally gaseous material such as light hydrocarbons, nitrogen, steam or the like.

Referring now to FIG. 1, feedstock is introduced into the coking process via line 1. The feedstock, which for purposes of this description is an extracted coal tar pitch, is heated in furnace 2 to a temperature normally in the range of about 850° F. to about 1100° F., and preferably between about 900° F. to about 975° F. A furnace that heats the coal tar pitch rapidly to such temperatures, such as a pipestill, is normally used. The coal tar pitch, which exits the furnace at substantially the above indicated temperatures, is combined with a nitrogen sparging gas from line 3 and the mixture is introduced through line 4 into the bottom of coke drum 5. Optionally the sparging gas may be introduced to the coke drum separate from the coal tar pitch. The coke drum is maintained at a pressure of between about 15 and about 200 psig and operates at a temperature in the range of about 800° F. to about 1000° F., more usually between about 820° F. and about 950° F. Inside the drum the coal tar pitch reacts to form cracked vapors and premium coke.

Cracked vapors are continuously removed overhead from the drum through line 6. Coke accumulates in the drum until it reaches a predetermined level at which time the feed to the drum is shut off and switched to a second coke drum **5*a* wherein the same operation is carried out. This switching permits drum 5*a*** to be taken out of service and the accumulated coke removed therefrom using conventional techniques. The coking cycle may require between about 16 and about 60 hours but more usually is completed in about 24 to about 48 hours.

The vapors that are taken overhead from the coke drums are carried by line 6 to a fractionator 7. As indicated in the drawing, the vapors will typically be fractionated into nitrogen and a $C_1$–$C_3$ product stream 8, a gasoline product stream 9, a light gas oil product stream 10 and a premium coker heavy gas oil stream taken from the bottom of the fractionator. The nitrogen may be recovered from the $C_1$–$C_3$ product by suitable means and recycled for reuse as sparging gas if desired.

As indicated previously, the premium coker heavy gas oil from the fractionator may be recycled at the desired ratio to the coker furnace through line 12. Any excess net bottoms may be withdrawn via line 11 and subjected to conventional residual refining techniques if desired.

Green coke is removed from coke drums 5 and **5*a* through outlets 13 and 13*a*, respectively, and introduced to calciner 14 where it is subjected to elevated temperatures to remove volatile materials and to increase the carbon to hydrogen ratio of the coke. Calcination may be carried out at temperatures in the range of between about 2000° F. and about 3000° F., and preferably between about 2400° and about 2600° F. The coke is maintained under calcining conditions for between about one half hour and about ten hours and preferably between about one and about three hours. The calcining temperature and the time of calcining will vary depending on the density of the coke desired. Calcined premium coke which is suitable for the manufacture of large graphite electrodes is withdrawn from the calciner through line 15**.

As mentioned previously, feedstocks suitable for providing the benefits of the invention are characterized by their high aromaticity and low molecular weight in the 750° F.+ fraction. This is exemplified by the results obtained in the examples. For example, thermal tar #2, which as shown in Table 4 has high aromaticity and low molecular weight in the 750° F.+ fraction, responds positively to the sparging process, as shown by Example 5. However, thermal tar #1, as shown in Example 4, does not provide favorable results even though it has low molecular weight, because the aromatic carbon content is too low. Another example is the pyrolysis tar used in Example 5. It is not a good feed because of the high molecular weight of its 750° F.+ fraction. This in spite of the fact that its aromatic carbon content is greater than that of thermal tar #2.

The diluent or sparging gas may be introduced to the coking reaction during the entire delayed coking cycle. However, it is believed that significant improvements would be obtained by sparging during the latter part of the cycle, such as the last eight hours of the cycle.

The following examples illustrate the results obtained in carrying out the invention.

EXAMPLE 1

A coal tar pitch with the properties shown in Table 4 was coked in a batch operation at 70 psig and 865° F. for 8 hours. The same feedstock was coked under identical conditions but with nitrogen sparging at the rate of 28 $ft^3$/hr/lb of feed for the first 22.5 minutes of the run (a total of 0.845 lb of nitrogen was used per lb of feed charged to the reaction). The data in Table 1 shows that coke CTE is much lower (3.2 vs. 5.2) and green coke size (78.6 weight percent +14 mesh vs. 45.1 weight percent) is much larger with sparging.

EXAMPLE 2

The same coal tar pitch coked under identical conditions as in Example 1 but with nitrogen passing through the reactor for the first 40 minutes during the sparging run shows an improvement in CTE (1.7 vs. 5.2) and green coke size (63.3 weight percent +14 mesh vs. 45.1 weight percent) with sparging.

EXAMPLE 3

The same coal tar pitch as used in Examples 1 and 2 was coked at 895° F. and 70 psig for 8 hours and at 925° and 70 psig for 8 hours. In separate runs under the same conditions nitrogen was added as in Example 1. The data in Table 1 again shows the improvement in CTE with nitrogren sparging.

These successful runs all utilized feedstocks having aromatic carbon content above 65 percent and molecular weight of the 750° F.+ fraction below 500.

TABLE 1

| | Example 1 | | Example 2 | | Example 3 | | | |
|---|---|---|---|---|---|---|---|---|
| | Base | Sparging | Base | Sparging | Base | Sparging | Base | Sparging |
| Coking Conditions | | | | | | | | |
| Coking Temperature °F. | 865 | 865 | 865 | 865 | 895 | 895 | 925 | 925 |
| Coking Pressure psig | 70 | 70 | 70 | 70 | 70 | 70 | 70 | 70 |
| Sparge Rate $\frac{\text{lb gas}}{\text{lb feed}}$ | 0 | .845 | 0 | 1.500 | 0 | 0.845 | 0 | 0.845 |
| Coke Properties | | | | | | | | |
| Coke CTE $10^{-7}$/°C. | 5.2 | 3.2 | 5.2 | 1.7 | 2.7 | 2.6 | 2.9 | 2.2 |

TABLE 1-continued

| | Example 1 | | Example 2 | | Example 3 | | | |
|---|---|---|---|---|---|---|---|---|
| | Base | Sparging | Base | Sparging | Base | Sparging | Base | Sparging |
| +14 Mesh Green Coke Wt % | 45.1 | 78.6 | 45.1 | 63.3 | 72.0 | 74.7 | 85.0 | 78.8 |
| Coke Yield Wt % | 57.5 | 28.6 | 57.5 | 22.1 | 54.2 | 25.0 | 51.4 | 25.1 |

EXAMPLE 4

A 720° F.+ fraction of thermal tar (#1) with the properties shown in Table 4 was coked at 70 psig for 8 hours at 865° F., 895° F. and 925° F. The same feedstock was coked under identical conditions but with nitrogen sparging at the rate of 14 $ft^3$/hr/lb of feed for 11 minutes (0.210 lb $N_2$/lb of feed) and 38 $ft^3$/hr/lb of feed for 11 minutes (0.420 lb $N_2$/lb of feed). A single run was made at 925° F. with a sparging rate of 28 $ft^3$/hr/lb of feed for 22.5 minutes (0.845 lb $N_2$/lb of feed).

The results of these runs are set forth in Table 2. It is apparent that sparging of this feedstock has no consistent beneficial effect on coke CTE or coke size. The lack of effectiveness of the process with this feedstock is attributed to its low (less than 65 percent) aromatic carbon content.

TABLE 3

| | No Sparge | | $N_2$ Sparge, 1,500 lb/lb of Feed | |
|---|---|---|---|---|
| Feedstock | Coke CTE, $10^{-7}$/°C. | Coke Yield* Wt % | Coke CTE, $10^{-7}$/°C. | Coke Yield* Wt % |
| Thermal Tar #2 | 1.92 | 44.2 | 1.01 | 10.2 |
| Pyrolysis Tar | 5.72 | 39.0 | 15.3 | 26.9 |
| Resid | 8.14 | 10.5 | 19.7 | 6.2 |

*Based on the whole feedstock

Thus, it has been demonstrated that improved coke properties are obtained by gas sparging during coking of feedstocks having a high aromatic carbon content and a low average molecular weight of the fraction from which most of the coke forms (750° F.+ fraction). Why these improvements are not obtained with premium coke feedstocks not meeting these criteria is not known for certain. However, provided the feedstocks meet the aromatic carbon and molecular weight requirements, significant improvements can be obtained for a variety of feedstocks.

TABLE 2

| | 865° F. | | | 895° F. | | | 925° F. | | | |
|---|---|---|---|---|---|---|---|---|---|---|
| Coking Conditions | | | | | | | | | | |
| Coking Temperature °F. | 865 | 865 | 865 | 895 | 895 | 895 | 925 | 925 | 925 | 925 |
| Coking Temperature psig | 70 | 70 | 70 | 70 | 70 | 70 | 70 | 70 | 70 | 70 |
| Sparge Rate $\frac{\text{lb gas}}{\text{lb feed}}$ | 0 | 0.210 | 0.420 | 0 | 0.210 | 0.420 | 0 | 0.210 | 0.420 | 0.845 |
| Coke CTE $10^{-7}$/°C. | 3.3 | 2.9 | 3.6 | 2.6 | 2.9 | 4.6 | 3.9 | 4.0 | 4.4 | 3.45 |
| +14 Mesh Green Coke Wt % | 55.6 | 70.1 | 77.6 | 85.0 | 80.9 | 86.6 | 92.1 | 88.1 | 85.2 | 72.1 |
| Coke Yield Wt %* | 24.0 | 21.6 | 17.8 | 21.6 | 19.5 | 13.6 | 20.6 | 16.2 | 12.6 | 5.8 |

*Based on the whole feedstock

EXAMPLE 5

A resid, a pyrolysis tar and a thermal tar (#2) with properties shown in Table 4 were topped to 720° F. and coked at 70 psig for 8 hours at 865° F. The same feedstocks were coked under identical conditions but with nitrogen sparging at the rate of 28 $ft^3$/hr/lb of feed for the first 40 minutes of the run. Table 3 shows that with the thermal tar (#2) a substantial improvement in CTE was obtained (1.01 vs. 1.92). In the case of the pyrolysis tar and resid, however sparging significantly increased the CTE.

TABLE 4

| | FEEDSTOCK PROPERTIES | | | | | | | | | |
|---|---|---|---|---|---|---|---|---|---|---|
| | Coal Tar Pitch | | Thermal Tar #2 | | Pyrolysis Tar | | Resid | | Thermal Tar #1 | |
| | Whole Feed | 750° F.+ | Whole Feed | 750° F.+ | Whole Feed | 750° F.+ | Whole Feed | 750° F.+ | Whole Feed | 720° F.+ |
| Specific Gravity @ 60° F. | 1.200 | — | 1.097 | — | 1.119 | — | 0.890 | — | 1.031 | — |
| $C^{13}$ Analysis, % of Carbon in the Aromatic Form | 92.2 | ~93 | 70.1 | 76.1 | 75.8 | 82.3 | 15.7 | 14.8 | 58.7 | 60.8 |
| Sulfur, Wt % | 0.71 | — | 0.30 | — | 1.03 | — | 0.07 | — | 0.71 | — |
| Conradson (Ramsbottom) Carbon Content, Wt % | 20.3 | — | 9.7 | — | 24.9 | — | 3.94 | — | 4.15 | — |
| Molecular Weight | 257 | 415 | 262 | 289 | 307 | 1090 | 251 | 738 | 295 | 334 |
| Weight Fraction of Whole Feed | — | 0.539 | — | 0.727 | — | 0.486 | — | 0.806 | — | 0.686 |

We claim:

1. A delayed premium coking process which comprises:

(a) heating an aromatic mineral oil feedstock to a temperature of from about 850° F. to about 1100° F., said feedstock having an aromatic carbon content of at least about 65 percent and a molecular weight of the fraction boiling above 750° F. not greater than about 650, (b) introducing the heated feedstock to a coking drum wherein said feedstocks soaks in its contained heat at a temperature between about 800° F. and about 1000° F. and a pressure between about 15 psig and about 200 psig to convert the feedstock to vapors and premium coke; and (c) carrying out the delayed coking while sparging with a non-coking diluent material which is a gas at coking conditions, whereby premium coke having reduced coefficient of thermal expansion is formed.

2. The process of claim 1 in which the aromatic mineral oil feedstock is selected from the group consisting of decant oil, pyrolysis tar, thermal tar, extracted coal tap pitch and mixtures thereof.

3. The process of claim 1 in which the non-coking diluent material is nitrogen.

4. A delayed premium coking process which comprises:

(a) heating an aromatic mineral oil feedstock to coking temperature, said feedstock having an aromatic carbon content of at least about 65 percent and a molecular weight of the fraction boiling above 750° F. not greater than about 650°;

(b) introducing the heated feedstock to a coking drum over a period of between about 16 and about 60 hours under delayed coking conditions wherein said feedstock soaks in its contained heat to convert the feedstock to cracked vapors and premium coke; and (c) carrying out the delayed coking in the presence of a sparging non-coking diluent material which is a gas at coking conditions and which is introduced during the last eight hours of the introduction of the feedstock to the coking drum whereby premium coke with reduced coefficient of thermal expansion is formed.

5. The process of claim 4 in which the aromatic mineral oil feedstock is selected from the group consisting of decant oil, pyrolysis tar, thermal tar, extracted coal tar pitch and mixtures thereof.

6. The process of claim 4 in which the non-coking diluent material is nitrogen.

7. The process of claim 4 in which the aromatic mineral oil feedstock is a thermal tar.

8. The process of claim 4 in which the aromatic mineral oil feedstock is an extracted coal tar pitch.

9. The process of claim 4 in which the mineral oil feedstock has an aromatic carbon content of at least 75 percent.

10. The process of claim 4 in which the molecular weight of the 750° F.+ fraction of the mineral oil feedstock is not greater than about 500.

* * * * *